US010026262B2

(12) United States Patent
Gnanasundram et al.

(10) Patent No.: US 10,026,262 B2
(45) Date of Patent: Jul. 17, 2018

(54) COMPUTER IMPLEMENTED FRAMEWORKS AND METHODOLOGIES FOR ENABLING SOFTWARE AUTHENTICATION AT AN ELECTRONIC GAMING MACHINE

(71) Applicant: Ainsworth Game Technology Limited, Newington (AU)

(72) Inventors: Baheerathan Gnanasundram, Wentworthville (AU); Vincent Carmelo Bruzzese, Oatlands (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 354 days.

(21) Appl. No.: 14/639,999

(22) Filed: Mar. 5, 2015

(65) Prior Publication Data

US 2015/0254930 A1 Sep. 10, 2015

(30) Foreign Application Priority Data

Mar. 6, 2014 (AU) ..... 2014900761

(51) Int. Cl.
*G07F 17/32* (2006.01)

(52) U.S. Cl.
CPC ..... *G07F 17/3241* (2013.01)

(58) Field of Classification Search
CPC ..... G07F 17/3241
USPC ..... 726/4
See application file for complete search history.

(56) References Cited

U.S. PATENT DOCUMENTS

| | | | | |
|---|---|---|---|---|
| 5,379,433 | A | 1/1995 | Yamagishi | |
| 5,694,471 | A | 12/1997 | Chen et al. | |
| 5,844,986 | A | 12/1998 | Davis | |
| 6,965,988 | B1 | 11/2005 | Hansmann et al. | |
| 7,549,922 | B2 | 6/2009 | Falvey et al. | |
| 7,801,829 | B2 | 9/2010 | Gray et al. | |
| 7,831,047 | B2 | 11/2010 | Rowe | |
| 7,996,916 | B2 | 8/2011 | Cockerille et al. | |
| 8,423,790 | B2 * | 4/2013 | Atashband | G06F 21/121 707/769 |
| 2003/0195033 | A1 | 10/2003 | Gazdic et al. | |
| 2006/0160626 | A1 | 7/2006 | Gatto et al. | |
| 2007/0149280 | A1 | 6/2007 | LeMay et al. | |
| 2008/0028235 | A1 * | 1/2008 | Smith | G06F 21/575 713/190 |
| 2008/0077803 | A1 | 3/2008 | Leach et al. | |
| 2009/0191961 | A1 | 7/2009 | McCoull et al. | |
| 2009/0276434 | A1 | 11/2009 | Harris et al. | |
| 2010/0120526 | A1 | 5/2010 | Singh | |
| 2010/0217992 | A1 | 8/2010 | Hamlin et al. | |
| 2010/0311500 | A1 | 12/2010 | Canterbury et al. | |
| 2012/0295693 | A1 * | 11/2012 | Bytnar | G07F 17/3225 463/25 |
| 2013/0133079 | A1 | 5/2013 | Eskin et al. | |
| 2015/0052616 | A1 * | 2/2015 | Hutchison | G06F 21/53 726/27 |

* cited by examiner

*Primary Examiner* — Kambiz Zand
*Assistant Examiner* — Benjamin Kaplan
(74) *Attorney, Agent, or Firm* — Cook Alex Ltd.

(57) ABSTRACT

Described herein is technology for enabling authentication of software instructions used in gaming machines. More specifically, the technology is directed to a situation where an electronic gaming machine operates based on two separate sets of software, being base data and game data.

20 Claims, 3 Drawing Sheets

COMPUTER IMPLEMENTED FRAMEWORKS AND METHODOLOGIES FOR ENABLING SOFTWARE AUTHENTICATION AT AN ELECTRONIC GAMING MACHINE

BACKGROUND

The invention relates to the field of electronic gaming machines (EMGs), and in particular to computer implemented frameworks and methodologies for enabling software authentication at an electronic gaming machine, for example thereby to prevent or limit tampering with the EGM and/or EGM software.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines provide games (often referred to as "casino-type games", such as slot games, video poker, keno, and the like) via the execution of software instructions. These software instructions commonly include "base data", for example an operating system, and "game data", which is specific to particular games.

It is of substantial importance to ensure that base data and game data are authentic. This is relevant both in terms of ensuring that "modified" games do not reach the market (as these could be detrimental to consumers) and for the protection of businesses that rely on the sale of game software.

Previously, there have been several disclosed systems that have been adapted or allow for the authentication of EGMs and software that is executed on EGM hardware. It is an object of the invention to overcome or substantially ameliorate one or more of the disadvantages of prior art, or at least to provide a useful alternative.

SUMMARY

One embodiment provides a method, performed by an electronic gaming machine, for authentication of software that is to be executed by the gaming machine, the method including:

reading a first stored value from a first software storage medium;

reading a second stored value from a second software storage medium;

processing the first and second stored values thereby to derive a primary authentication value;

calculating a first hash value for the first storage medium;

calculating a second hash value for the second storage medium;

processing the first and second hashed values thereby to derive a secondary authentication value;

comparing the primary authentication value to the secondary authentication value and, based on that comparing, performing one of the following:

(i) enabling execution of software stored on the first storage medium and second storage medium; or (ii) preventing execution of software stored on the first storage medium and preventing execution of software stored on the second storage medium.

One embodiment provides a method wherein the method is automatically performed when the electronic gaming machine is powered on.

One embodiment provides a method wherein the method is performed via execution of BIOS code for the electronic gaming machine.

One embodiment provides a method wherein the first software storage medium maintains base data for the electronic gaming machine, including code defining all or part of an operating system.

One embodiment provides a method wherein the second software storage medium maintains game data for an electronic gaming machine game, including code defining all or part of such a game.

One embodiment provides a method wherein processing the first and second stored values thereby to derive a primary authentication value includes decrypting each of the first and second stored values thereby to define a decrypted first value and decrypted second value.

One embodiment provides a method wherein processing the first and second stored values thereby to derive a primary authentication value includes combining the decrypted first value and decrypted second value.

One embodiment provides a method wherein the combining includes concatenating.

One embodiment provides a method claim wherein comparing the primary authentication value to the secondary authentication value includes determining whether they are identical, and performing (i) only in the case that they are identical.

One embodiment provides a method an electronic gaming machine configured to perform a method as described herein.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

As used herein, the term "exemplary" is used in the sense of providing examples, as opposed to indicating quality. That is, an "exemplary embodiment" is an embodiment provided as an example, as opposed to necessarily being an embodiment of exemplary quality.

BRIEF DESCRIPTION OF THE DRAWINGS

Preferred embodiments of the invention will now be described, by way of example only, with reference to the accompanying drawings in which.

DETAILED DESCRIPTION OF VARIOUS EMBODIMENTS

Figure 1:
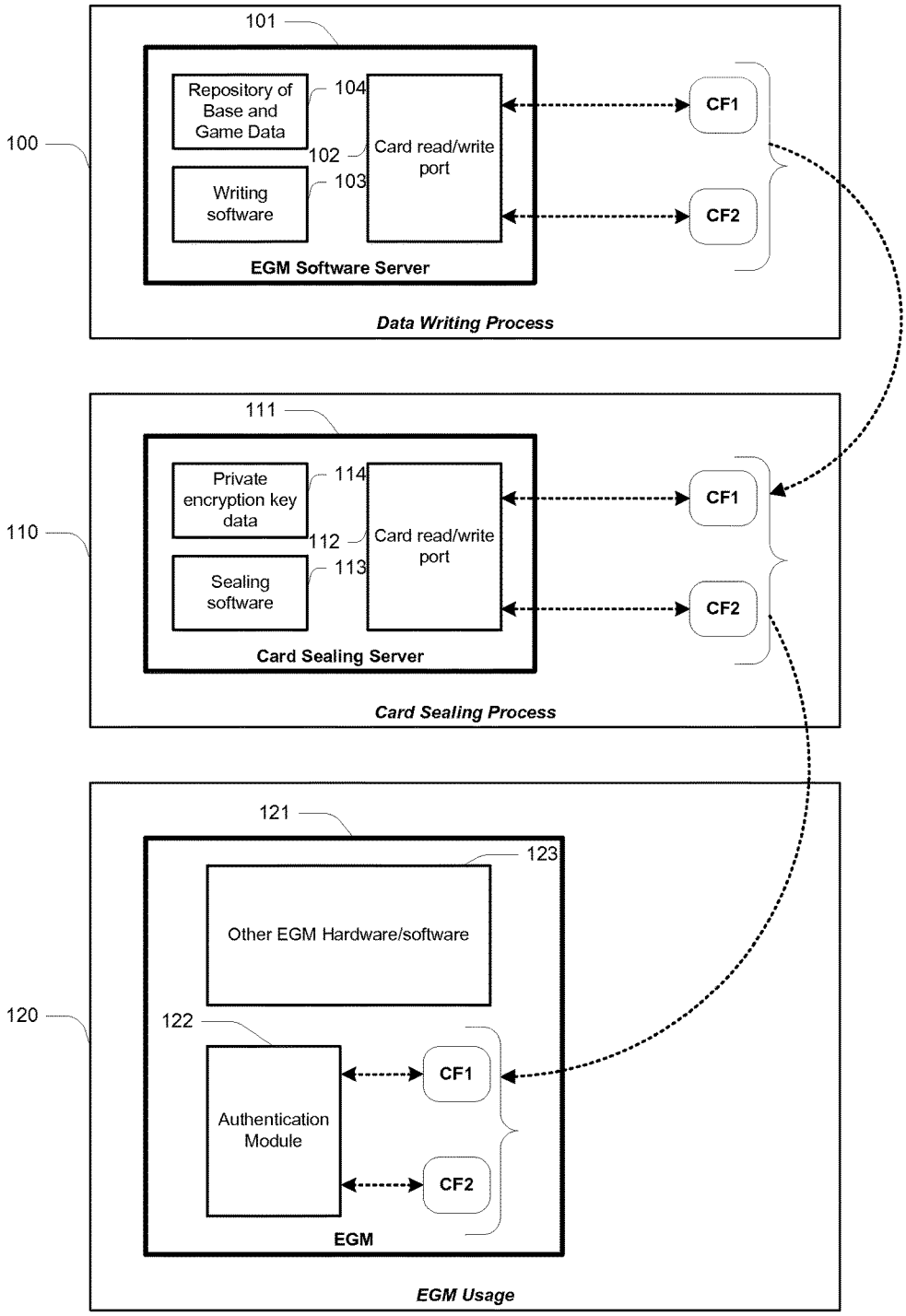
FIG. 1 provides an overview of a methodology according to one embodiment.

FIG. 1 illustrates a process whereby EGM software is securely stored on carrier media, and subsequently authenticated by an EGM. In this example, the carrier media are two individual compact flash cards CF1 and CF2. However, it will be appreciated that a range of other carrier media are present in alternate implementations.

The process of FIG. 1 includes three distinct stages, being a data writing process 100, a card sealing process 110, and EGM usage 120.

Referring initially to data writing process 100, an EGM software server 101 includes a card read/write port 102, which is used as a means to functionally interact with cards CF1 and CF2 (typically sequentially). Writing software, defined by computer executable code that is executed via one or more microprocessors, enables server 101 to write data to each of CF1 and CF2. In this example, the data to be written is maintained in a repository 104, which includes both "base data" and "game data". In this regard:

Base data refers to a set of computer executable instructions that define base software for the EGM, for example including but not limited to an operating system. The base data is configured to be executed by a variety of EGMs, and enable the loading and execution of various different types of games.

Game data refers to computer executable instructions that define an individual game (or group of games) that are to be executed via an EGM that has loaded the base data.

It will be appreciated that, in a practical situation, a gaming venue will have a plurality of machines, each running the same base data, but with the machines collectively being loaded with variety of different examples of game data (i.e. machines providing different specific games). Generally, the base data is loaded by the EGM first, and then the game data then loaded subsequently.

Although the example of FIG. 1 indicates that a common server and repository is used for both base data and game data, it will be appreciated that in other embodiments separate servers and/or repositories may be used for the base data and the game data.

For the sake of this example, it is assumed that base data is written to CF1, and game data for a given game is written to CF2. It should be noted that the processes of writing to each of these cards need not occur concurrently or consecutively; the processes of writing base and game data may occur at distinct times and/or locations. For example, it will be appreciated that cards containing game data are sent to sites far more often than cards with base data (as an EGM may change games many times over the life of its base data).

Turning now to process 110, following the writing of base data to CF1 and game data to CF2, these cards are each individually provided to a card sealing server 111. Server 111 includes a card read/write port 112, and sealing software 113. Sealing software 113 is configured to perform a hashing process in respect of data existing on a given flash card (for example a SHA-1 hash), encrypt that hash based on a private encryption key (stored in private encryption key data 114). Private encryption key data 114 is preferably guarded by various technical and practical security protocols thereby to prevent unauthorised parties from gaining access, and hence prevent such parties from being able to define the same encrypted hash as would be defined by server 111.

Again, it will be appreciated that process 110 need not occur at a common or generally common time for both of cards CF1 and CF2 (or, for that matter, using a common server, so long as there is access to software 113 and data 114).

Data 114 is preferably indicative of a private/public asymmetrical encryption key. That is, whereas the key used to perform encryption is maintained in a secret state, a key used to enable decryption may be public (that is, the key may be operatively installed on devices that are operated in non-secure locations, such as EGMs).

Although processes 100 and 110 are described by reference the card being loaded into a read/write port located at a server, in other embodiments the read/write port is provided by an alternate device that communicates with the sever over a communications network.

Referring now to process 120, cards CF1 and CF2 are inserted into an EGM 121. In this embodiment, the EGM includes hardware such as: an electronic storage device, CPU, display screen, speakers, and series of buttons for gameplay. Typically, a user or player of the EGM may wager money, coins or credit on the outcomes of games of chances being operated or run on the EGM. If successful, the player receives a prize in the form of credits, money or coins. Generally, randomised symbols are shown or depicted on the screen or display of the EGM and depending on the outcomes of the randomised symbols, the randomised symbols may match with a predetermined game rules or a paytable. The player is awarded the corresponding prize from the paytable based on the amount wagering or the betting options selected. For the purposes of FIG. 1, EGM 121 is illustrated in a simplified form showing an authentication module 122 (which is defined by software instructions, such as BIOS software, executable by processing components of the EGM) and "other" EGM hardware and software 123.

Authentication module 122 is configured to perform an authentication process in respect of CF1 and CF2. Detailed examples are described further below. However, in general terms, the authentication process includes performing a hash (again for example a SHA-1 hash) of each of CF1 and CF2, using those to define a combined hash of CF1 and CF2 (for example by defining a concatenated hash value), and combining that with a correspondingly combined hash of the decrypted has values with which CF1 and CF2 are sealed. The EGM only becomes operable if the two combined hash values match.

Although examples described herein refer primarily to authentication occurring at machine start-up (via a BIOS-driven authentication process), there may also be subsequent authentication. For example, in relation to relatively large prizes or wins awarded by the EGM, it may be necessary to validate or authenticate the software within the EGM and confirm that the software and base code has not been tampered with or modified in an unauthorised manner.

Figure 2A:
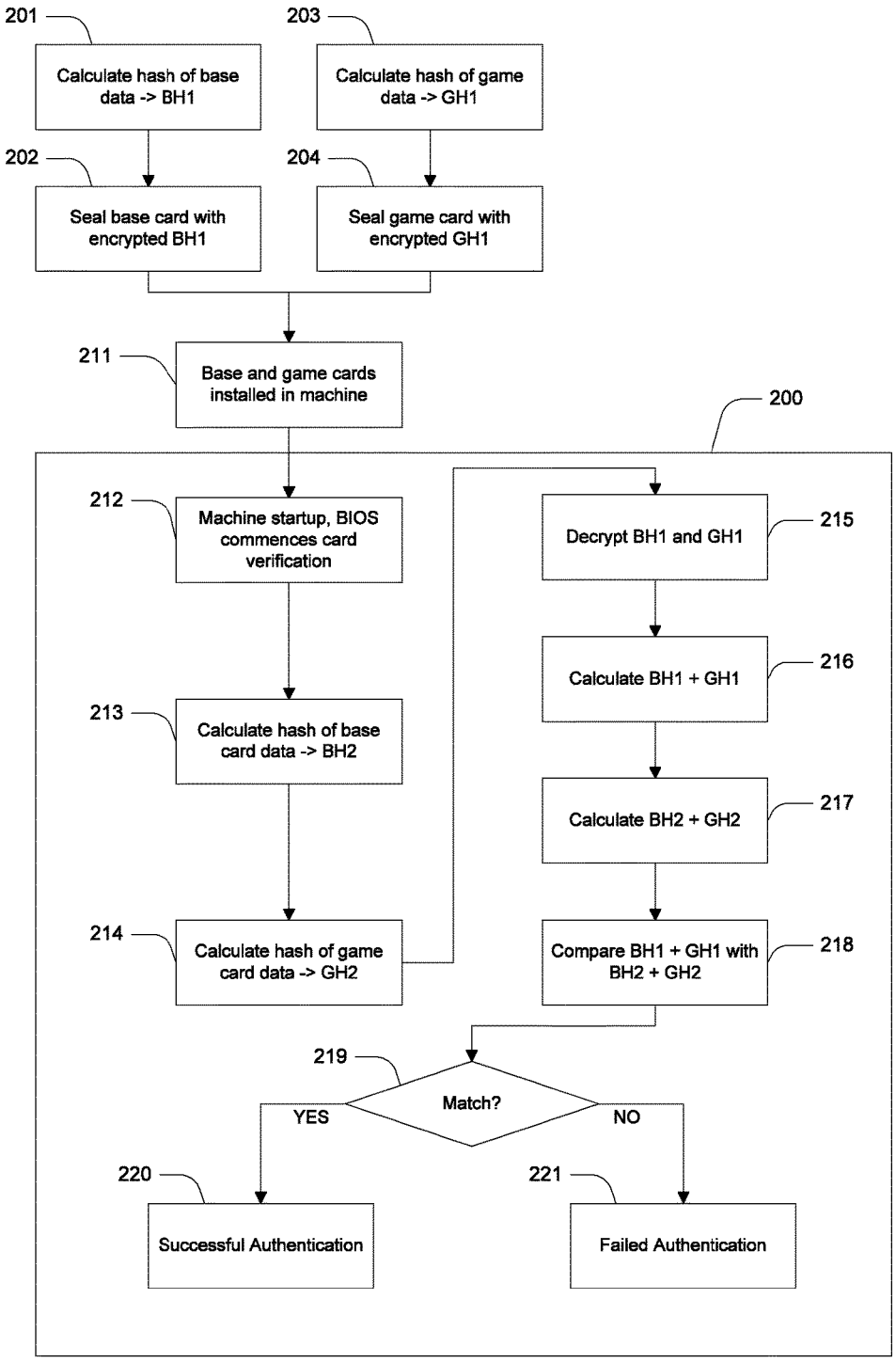
FIG. 2A shows an authentication method according to one embodiment.

FIG. 2A depicts an authentication method 200 performed by authentication module 122 of FIG. 1. This process is preferably conducted upon start-up or powering on the EGM, for example using software instructions defined in system BIOS. It will be appreciated that steps in method 200 may be re-ordered to some extent without affecting the overall functionality.

Prior to commencement of method 200, the base card (CF1) is hashed at 201 and (thereby to define a hash value BH1) sealed by server 210 at 202 with an encrypted BH1, and the game card (CF2) is hashed at 203 and (thereby to define a hash value GH1) sealed by server 210 at 204 with an encrypted GH1. CF1 and CF2 are inserted into EGM 121 at 211, and method 200 commences thereafter upon machine start-up at 212.

Step 213 represents a process including calculating a hash of the base card data on CF1; this is referred to as BH2. Similarly, step 214 represents a process including calculating a hash of the game card data on CF2; this is referred to as GH2.

Step 214 represents decrypting BH1 and GH1. These are combined at 216 thereby to define BH1+GH1. Similarly, at 217 there is a combining of BH2 and GH2 thereby to define BH2+GH2. These combinations may occur in a number of ways. For example, this step may utilise any concatenation, arithmetic summing, or substantially any other combination technique. BH1+GH1 is then compared with BH2+GH2 at 218. As indicated by decision 219, in the case of a match this leads to successful authentication at 220. This preferably results in loading of the base and game data, thereby to enable functional use of EGM 121. If there is no match, authentication fails at 221. This preferably results in an error message, and prevention of loading of the base data and/or game data (hence preventing functional use of EGM 121).

Figure 2B:
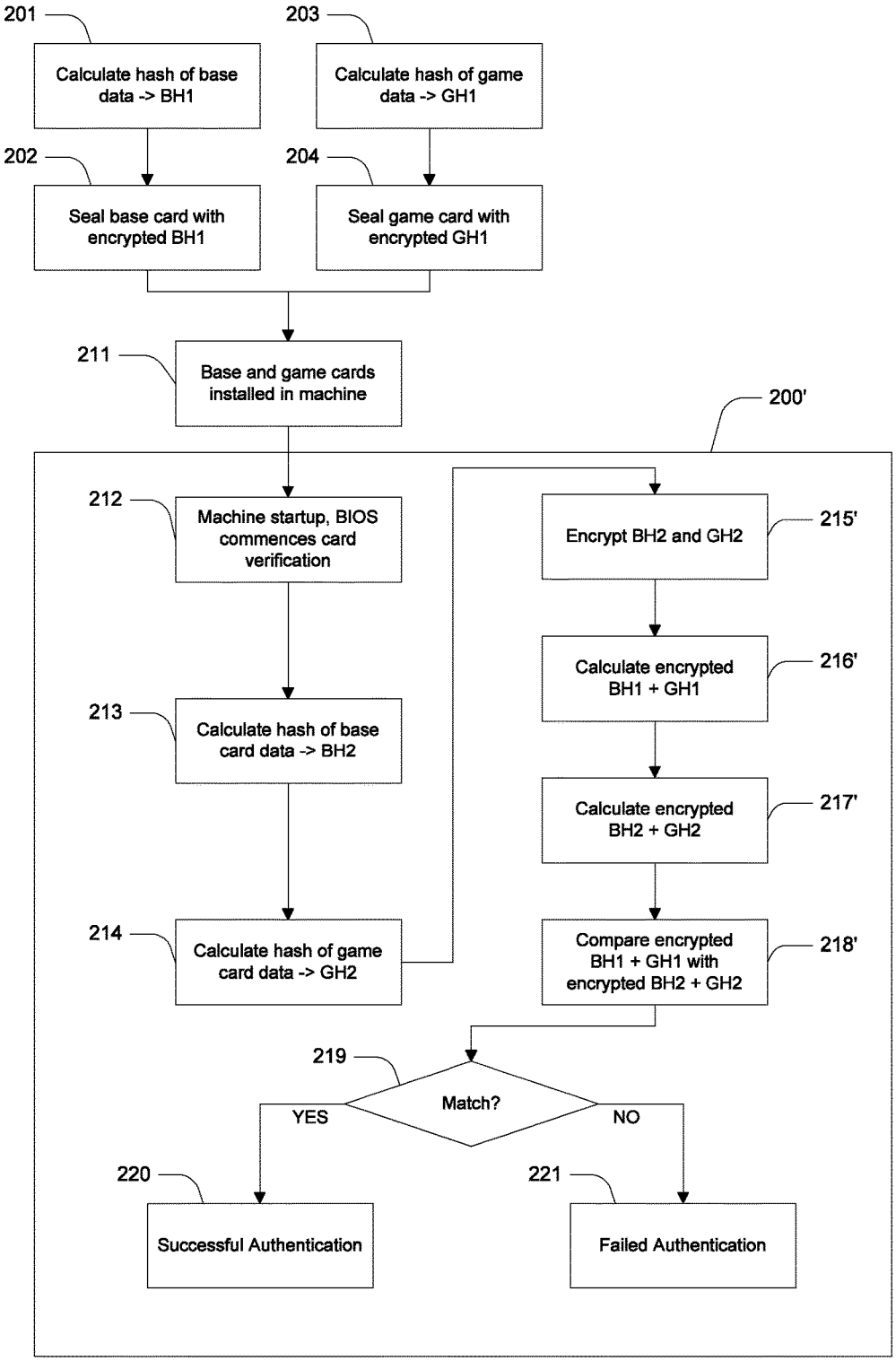
FIG. 2B shows an authentication method according to one embodiment.

FIG. 2B illustrates an alternate method 200' where summed encrypted hashes are used as an alternative (see steps 215' to 218').

In summary, the calculation of BH1 and GH1, and subsequent sealing of the cards, may be also performed in-house by the manufacturer or distributor using confidential encryption keys. The remaining steps are performed by the EGMs BIOS prior to allowing the machine to load the base or game data.

An important aspect of this process is that the comparison is performed in respect of the summed hashes. That is, the comparison is between (BH1+GH1) and (BH2+GH2) as opposed to any individual comparisons (for example at no stage is BH1 compared to BH2, or GH1 is compared to GH2 in isolation).

In terms of what is meant by "summed hashes", the process is, at least in some embodiments, to perform a hash combining process. For example, this may include summing two 160 bit hashes results in a 320 bit hash. However, various approaches of hash combining may be used. As context, assume:

The Base Code hash is "1234".

The Game Code hash is "5678"

By way of straightforward concatenation, the combined hash is "12345678"—the signatures are added together in portmanteau format. Alternately, a mathematical sum may be used, resulting in 6912—the signatures are converted to numbers or numerical representations and mathematically added together. In another scenario, the combines hash is "1256"—the signatures are truncated to include a selected prefix or suffix and these partial signatures are added together in portmanteau format. A further example yields "58"—the signatures are truncated to include a selected prefix or suffix and these partial signatures are added together mathematically wherein in this example the prefixes "56" and "12" are added together. It will be appreciated that these and other approaches may be used, nothing that the same form of combining occurs for BH1+GH1 as for BH2+GH2.

It will be appreciated that the methodologies above provide useful authentication failsafe measures thereby to prevent the operation of a gaming machine based on either inauthentic game data or base data. Furthermore, this is achieved in a procedurally efficient manner, requiring only a single value comparison and determination based on hash combination/concatenation.

Although the invention has been described with reference to specific examples, it will be appreciated by those skilled in the art that the invention may be embodied in many other forms.

The invention claimed is:

1. A method, performed by an electronic gaming machine, for authentication of software that is to be executed by the gaming machine, the software comprising base data of which a hash has been calculated, encrypted and stored on a first memory card as a first stored value with the base data and game data of which a hash has been calculated, encrypted and stored on a second memory card as a second stored value with the game data, the method including:

receiving the first memory card in a card port of the electronic gaming machine and reading the first stored value from the first memory card;

receiving the second memory card in a card port of the electronic gaming machine and reading the second stored value from the second memory card;

according to a first option, decrypting and combining the first and second stored values thereby to derive a primary authentication value, or according to a second option, combining the first and second stored values to thereby derive the primary authentication value;

calculating a first hash value for the base data on the first memory card;

calculating a second hash value for the game data on the second memory card;

according to the first option, combining the first and second hashed values thereby to derive a secondary authentication value, or according to the second option, encrypting and combining the first and second hashed values thereby to derive the secondary authentication value;

comparing the primary authentication value to the secondary authentication value and, based on that comparing:

(i) enabling execution of software stored on the first memory card and second memory card if the primary authentication value matches the secondary authentication value; or (ii) preventing execution of software stored on the first memory card and preventing execution of software stored on the second memory card if the primary authentication value does not match the secondary authentication value.

2. The method according to claim 1, wherein the method is automatically performed when the electronic gaming machine is powered on.

3. The method according to claim 1, wherein the method is performed via execution of BIOS code for the electronic gaming machine.

4. The method according to claim 1, wherein the base data includes code defining all or part of an operating system.

5. The method according to claim 1, wherein the game data includes code defining all or part of such a game.

6. The method according to claim 1, wherein processing the first and second stored values thereby to derive a primary authentication value includes decrypting each of the first and second stored values thereby to define a decrypted first value and decrypted second value.

7. A method, performed by an electronic gaming machine, for authentication of software that is to be executed by the gaming machine, the software comprising base data of which a hash has been calculated, encrypted and stored on a first memory card as a first stored value with the base data and game data of which a hash has been calculated, encrypted and stored on a second memory card as a second stored value with the game data, the method including:

receiving the first memory card in a card port of the electronic gaming machine and reading the first stored value from the first memory card;

receiving the second memory card in a card port of the electronic gaming machine and reading the second stored value from the second memory card;

processing the first and second stored values thereby to derive a primary authentication value, including decrypting each of the first and second stored values thereby to define a decrypted first value and decrypted second value;

calculating a first hash value for the base data on the first memory card;

calculating a second hash value for the game data on the second memory card;

processing the first and second hashed values thereby to derive a secondary authentication value;

comparing the primary authentication value to the secondary authentication value and, based on that comparing:

(i) enabling execution of software stored on the first memory card and second memory card if the primary authentication value matches the secondary authentication value; or (ii) preventing execution of software stored on the first memory card and preventing execution of software stored on the second memory card if the primary authentication value does not match the secondary authentication value, wherein processing the first and second stored values thereby to derive a primary authentication value includes combining the decrypted first value and decrypted second value.

8. The method according to claim 7, wherein the combining includes concatenating.

9. A method, performed by an electronic gaming machine, for authentication of software that is to be executed by the gaming machine, the software comprising base data of which a hash has been calculated, encrypted and stored on a first memory card as a first stored value with the base data and game data of which a hash has been calculated, encrypted and stored on a second memory card as a second stored value with the game data, the method including:

receiving the first memory card in a card port of the electronic gaming machine and reading the first stored value from the first memory card;

receiving the second memory card in a card port of the electronic gaming machine and reading the second stored value from the second memory card;

processing the first and second stored values thereby to derive a primary authentication value, including decrypting each of the first and second stored values thereby to define a decrypted first value and decrypted second value;

calculating a first hash value for the base data on the first memory card;

calculating a second hash value for the game data on the second memory card;

processing the first and second hashed values thereby to derive a secondary authentication value;

comparing the primary authentication value to the secondary authentication value and, based on that comparing:

(i) enabling execution of software stored on the first memory card and second memory card if the primary authentication value matches the secondary authentication value; or (ii) preventing execution of software stored on the first memory card and preventing execution of software stored on the second memory card if the primary authentication value does not match the secondary authentication value, wherein processing the first and second hashed values thereby to derive a secondary authentication value includes combining the first and second hashed values thereby to derive a secondary authentication value.

10. The method according to claim 9, wherein the combining includes concatenating.

11. An electronic gaming machine configured to perform a method, the method for authentication of software that is to be executed by the gaming machine, the software comprising base data of which a hash has been calculated, encrypted and stored on a first memory card as a first stored value with the base data and game data of which a hash has been calculated, encrypted and stored on a second memory card as a second stored value with the game data and including:

receiving the first memory card in a card port of the electronic gaming machine and reading the first stored value from the first memory card;

receiving the second memory card in a card port of the electronic gaming machine and reading the second stored value from the second memory card;

according to a first option, decrypting and combining the first and second stored values thereby to derive a primary authentication value, or according to a second option, combining the first and second stored values to thereby derive the primary authentication value;

calculating a first hash value for the base data on the first memory card;

calculating a second hash value for the game data on the second memory card;

according to the first option, combining the first and second hashed values thereby to derive a secondary authentication value, or according to the second option, encrypting and combining the first and second hashed values thereby to derive the secondary authentication value;

comparing the primary authentication value to the secondary authentication value and, based on that comparing:

(i) enabling execution of software stored on the first memory card and second memory card if the primary authentication value matches the secondary authentication value; or (ii) preventing execution of software stored on the first memory card and preventing execution of software stored on the second memory card if the primary authentication value does not match the secondary authentication value.

12. The electronic gaming machine according to claim 11, wherein the method is automatically performed when the electronic gaming machine is powered on.

13. The electronic gaming machine according to claim 11, wherein the method is performed via execution of BIOS code for the electronic gaming machine.

14. The electronic gaming machine according to claim 11, wherein the base data includes code defining all or part of an operating system.

15. The electronic gaming machine according to claim 11, wherein the game data includes code defining all or part of such a game.

16. The electronic gaming machine according to claim 11, wherein processing the first and second stored values thereby to derive a primary authentication value includes decrypting each of the first and second stored values thereby to define a decrypted first value and decrypted second value.

17. An electronic gaming machine configured to perform a method, the method for authentication of software that is to be executed by the gaming machine, the software comprising base data of which a hash has been calculated, encrypted and stored on a first memory card as a first stored value with the base data and game data of which a hash has been calculated, encrypted and stored on a second memory card as a second stored value with the game data and including:

receiving the first memory card in a card port of the electronic gaming machine and reading the first stored value from the first memory card;

receiving the second memory card in a card port of the electronic gaming machine and reading the second stored value from the second memory card;

processing the first and second stored values thereby to derive a primary authentication value, including decrypting each of the first and second stored values thereby to define a decrypted first value and decrypted second value;

calculating a first hash value for the base data on the first memory card;

calculating a second hash value for the game data on the second memory card;

processing the first and second hashed values thereby to derive a secondary authentication value;

comparing the primary authentication value to the secondary authentication value and, based on that comparing:

(i) enabling execution of software stored on the first memory card and second memory card if the primary authentication value matches the secondary authentication value; or (ii) preventing execution of software stored on the first memory card and preventing execution of software stored on the second memory card if the primary authentication value does not match the secondary authentication value, wherein processing the first and second stored values thereby to derive a primary authentication value includes combining the decrypted first value and decrypted second value.

18. The electronic gaming machine according to claim 17, wherein the combining includes concatenating.

19. An electronic gaming machine configured to perform a method, the method for authentication of software that is to be executed by the gaming machine, the software comprising base data of which a hash has been calculated, encrypted and stored on a first memory card as a first stored value with the base data and game data of which a hash has been calculated, encrypted and stored on a second memory card as a second stored value with the game data and including:

receiving the first memory card in a card port of the electronic gaming machine and reading the first stored value from the first memory card;

receiving the second memory card in a card port of the electronic gaming machine and reading the second stored value from the second memory card;

processing the first and second stored values thereby to derive a primary authentication value, including decrypting each of the first and second stored values thereby to define a decrypted first value and decrypted second value;

calculating a first hash value for the base data on the first memory card;

calculating a second hash value for the game data on the second memory card;

processing the first and second hashed values thereby to derive a secondary authentication value;

comparing the primary authentication value to the secondary authentication value and, based on that comparing:

(i) enabling execution of software stored on the first memory card and second memory card if the primary authentication value matches the secondary authentication value; or (ii) preventing execution of software stored on the first memory card and preventing execution of software stored on the second memory card if the primary authentication value does not match the secondary authentication value, wherein processing the first and second hashed values thereby to derive a secondary authentication value includes combining the first and second hashed values thereby to derive a secondary authentication value.

20. The electronic gaming machine according to claim 19, wherein the combining includes concatenating.

* * * * *